United States Patent [19]

Roop

[11] Patent Number: 4,829,798

[45] Date of Patent: May 16, 1989

[54] COMBINATION SWITCH LOCK/CAM LOCK ASSEMBLY

[75] Inventor: Stevie C. Roop, Dugspur, Va.

[73] Assignee: Medeco Security Locks, Inc., Salem, Va.

[21] Appl. No.: 106,043

[22] Filed: Oct. 7, 1987

[51] Int. Cl.[4] ..... E05B 17/04

[52] U.S. Cl. ..... 70/379 R; 70/380

[58] Field of Search ..... 70/379 R, 379 A, 380, 70/139

[56] References Cited

U.S. PATENT DOCUMENTS

| | | | |
|---|---|---|---|
| 2,275,362 | 3/1942 | Golden | 70/380 |
| 2,837,908 | 6/1958 | Segal | 70/379 R |
| 2,962,888 | 12/1960 | Ahlquist | 70/379 R |
| 3,740,979 | 6/1973 | Crepinsek | 70/139 |
| 4,603,566 | 8/1986 | Kruehn | 70/380 |

FOREIGN PATENT DOCUMENTS

| | | | |
|---|---|---|---|
| 1125807 | 3/1962 | Fed. Rep. of Germany | 70/379 R |

*Primary Examiner*—Robert L. Wolfe

*Attorney, Agent, or Firm*—Bernard, Rothwell & Brown

[57] ABSTRACT

A combination switch lock/cam lock assembly which includes a one-piece shell, a plug with a tenon, an electrical switch, and a cam is insertable from the front face of a panel opening by not affixing the cam until after the lock is inserted. After the lock is inserted in the panel and secured by a panel nut, the cam is installed by insertion through a slot in the shell to engage and be rotated by the tenon, and a spring-like retainer carried by the cam grips the tenon to retain the cam on the tenon and prevent the cam from being easily removed from the shell.

3 Claims, 1 Drawing Sheet

Medeco
Medeco

COMBINATION SWITCH LOCK/CAM LOCK ASSEMBLY

BACKGROUND OF THE INVENTION

1. Field of the Invention

This invention relates to improvements in locks, and particularly to a unique combination switch lock/cam lock assembly.

2. Description of the Background Art

Switch locks are currently available in the art with different types of switches Medeco Security Locks, Inc. ("Medeco") of Salem, Virginia, has sold ¾" diameter switch locks with a wide range of electrical functions combined with the security and key control of a Medeco cylinder. Switch locks are ideally suited for applications requiring controlled access to electrically activated systems such as burglar alarms, electronic information systems, cash controlled systems, electrically controlled doors and gates, and the like.

Similarly, cam locks are well known in the art. Medeco also sells a high security cam lock of ¾" diameter providing protection against surrepticious entry, resistance to physical attack and key integrity. Cam locks have a wide variety of uses ranging from pay telephones, automatic bank tellers, data processing equipment, parking meters, gas pump meters, burglar alarm controllers, various cabinets such as gun racks, narcotics cabinets, and the like.

There is also known in the art a combination switch lock/cam lock design which has a dress nut on the front of the assembly so as to mount the assembly from the rear of the panel. That is, the lock shell is headless so as to fit through a panel opening from the rear, and the lock is held in the panel opening by a mounting nut abutting the panel rear and a dress nut abutting the panel front, both nuts being threaded on the lock shell. Such known prior art is a lock of this nature sold by C & K Components, Inc. of Clayton, N.C. When mounting the assembly from the rear of the panel with a dress nut threaded on from the front, the lock can be relatively easily defeated by a wrongdoer who can thread the dress nut off and remove the lock.

Accordingly, there is a need in the art for a combination switch lock/cam lock which can be mounted from the front so that it is not easily defeated. However, the opening in a panel for mounting a switch lock/cam lock is ordinarily the size of the shell Therefore, since a cam protrudes from the side of a shell, such can not be front mounted with a cam installed. If one were to demount the cam in order to insert a switch lock/cam lock from the front of a panel, such would take considerable time and effort to assemble and disassemble and hence is impractical.

Accordingly, there is a need in the art for a combination switch lock/cam lock assembly which is highly defeat resistant, which can be mounted from the front of a panel, and which is simple and easy to assemble and install.

SUMMARY OF THE INVENTION

This invention provides a high security combination switch lock/cam lock assembly which is resistant to defeat and does not have a dress nut which can be unthreaded to defeat the lock. More particularly, the switch lock/cam lock assembly of this invention has a shell insertable from the front of a panel, the shell having a flange to overlie a panel opening and a threaded panel nut to tighten the shell in the panel. A cylindrical lock plug of the high security type is insertable into the shell and has a tenon extending therefrom for operating an electric switch at the inner end of the shell. The shell has a circumferential opening to accommodate a cam. A cam is attached to the plug tenon after the shell of the switch lock/cam lock is inserted from the front of the panel. In order to hold the cam in place, a retainer is provided, the retainer having a resilient spread arms for holding onto the plug tenon at a groove thereon and having the other end shaped to fit into and attach onto the cam. Thus, the cam and retainer can be inserted through the opening in the shell to rigidly affix the cam to the plug tenon after the shell and plug are inserted from the front of the panel.

DETAILED DESCRIPTION OF THE PREFERRED EMBODIMENT

Figures 1, 2, 3:
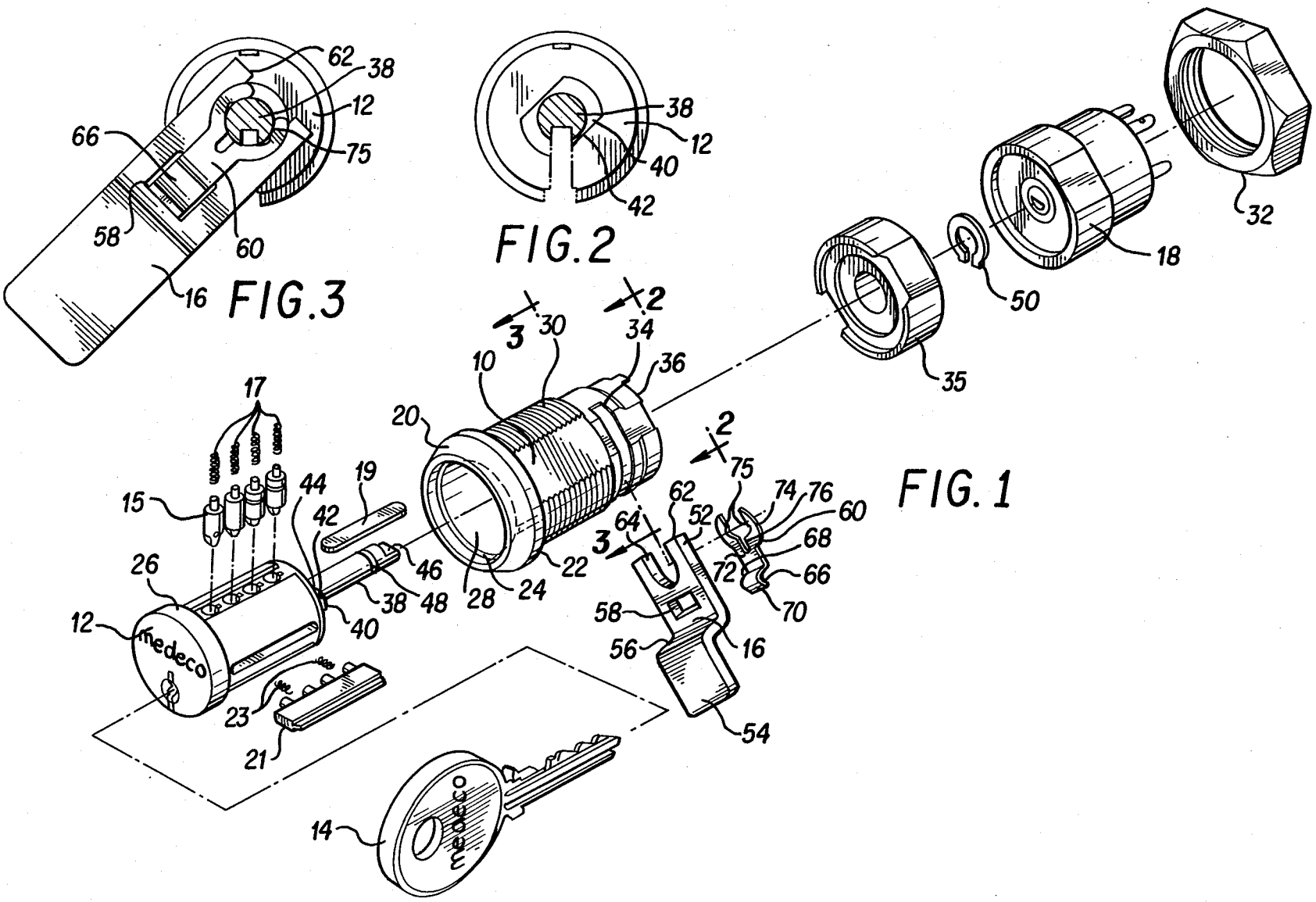
FIG. 1 is an exploded view of the combination of the switch lock/cam lock assembly of this invention.
FIG. 2 is a section view taken along line 2—2 of FIG. 1.
FIG. 3 is a section view taken along line 3—3 of FIG. 1.

As shown in FIG. 1 the lock of this invention, which is adapted to be inserted from the front of a panel through a panel opening, includes the following major components: a shell 10, a plug 12 operable by a key 14, a cam 16, and a switch assembly 18.

The shell 10, is a one-piece shell having a head 20, with a flange 22 for bearing against the opening in a panel. There is a cylindrical recess 24 in the face of the shell to accommodate a head 26 on plug 12 so that the face of the plug is flush with the face of the shell. The shell has an axial cylindrical bore 28 extending therethrough to accommodate the body of the plug. The outer surface of the shell bears threads 30 behind the flange 22. These threads accommodate a mounting nut 32. The inside of the shell may be configured to receive the side bar of the Medeco plug as is known in the art. The shell is provided with a circumferential slot 34 to accommodate the cam 16. The inner end 36 of the shell is configured as is known in the art to mount any suitable type of switch 18.

The plug 12 is preferably of the type made by Medeco such as disclosed in U.S. Pat. No. 3,722,240 granted Mar. 27, 1973 but with the offset tumbler as disclosed in U.S. Pat. No. 4,635,455 granted Jan. 13, 1987. Because the plug per se with its tumbler pins 15, tumbler pin springs 17, spring cover 19, sidebar 21, and sidebar springs 23 is known in the art described in U.S. Pat. No. 3,722,240, and is not modified in any unique form for this invention, it need not be further described except to say that the plug has a rearwardly extending tenon 38 which is rotated when the proper key 14 is inserted into the plug and rotated. The tenon 38 includes a portion 40 adjacent the rear end of the plug having flats 42 for receiving the cam 16. Immediately to the rear of portion 40 is a recessed groove 44 to accommodate a cam retainer 60 as will be described. A configuration 46 on the rear end of the tenon is to operate the known switch assembly 18.

Because the switch assembly 18 may be any one of the known types of such switches, e.g. those used on Medeco locks; and because such are not unique nor are they modified nor do they per se constitute a part of this invention, they need not be further described. Various types of switches such as single pole switches, double pole switches are preferably mounted behind a top plate 35 which is preferably untrasonically welded to the rear end 36 of the shell 10. One suitable switch utilized in the preferred embodiment is made by C & K Components Inc. of Clayton, N.C., Model No. CP-151380.

A groove 48 in the rear end of the tenon may be utilized to accommodate a grip ring 50 positioned behind the switch 18 in order to further position and hold the tenon and plug in the shell.

The cam 16 may be formed in various shapes to accomplish its mechanical locking function. It is illustrated as an offset cam with two end portions 52 and 54 which are offset by a central portion 56. In the end portion 52 adjacent the offset there is a rectangular opening 58 which extends through the cam to accommodate one end of cam retainer 60 The outer end of end portion 54 of the cam 16 contains a pair of spaced arms 62 having flat parallel inside surfaces 64 which strattle the flats 42 on portion 40 of the plug tenon 38. With the opening between the spaced-apart arms 62, it is seen that the cam 16 can be slipped over the tenon 38 and when the plug is rotated, the flats 40 contacting the sides 64 of the cam 16 will cause the cam to swing in an arc. The cam 16, of course, is inserted through the circumferential slot 34 and the shell. However, without means to hold the cam 16 in place, the cam would not stay on the tenon 38. According to this invention the unique cam retainer 60 is provided for holding the cam onto the plug. The retainer 60 includes an end portion 66 which is bent so as to fit snugly into the rectangular opening 58 from either side of the cam 16. Surface 68 of retainer 60 contacts one portion of the rectangular opening 58 and end 70 contacts the other portion of the rectangular opening while compressing the end so as to provide a spring effect holding the end of the retainer 60 tightly against the cam 16. A face 72 of the retainer lies on top of the cam. The retainer also has spaced-apart arms 74 and a cut-out portion 66. The entire retainer is preferably formed of cold-rolled carbon steel and tee arms 74 may be forced apart. The arms 74 have gripping portions 76 on their inner surfaces for gripping the groove 48 in the tenon 38 on the side of the axis of the tenon opposite the main body of the retainer 60 and cam 16. Because of the configuration, the retainer and cam cannot be easily removed, i.e., they cannot be pulled off by hand. The retainer also acts as a vibration damper due to its spring-like construction.

For assembly in the factory the plug 12, shell 10, and switch 18 are assembled together in a known manner, while the cam 16, retainer 60 and nut 32, as well as key 14 are shipped separately and unassembled to a customer for installation.

For installation, the assembled shell 10, plug 12 and switch 18 are placed through an opening in the panel board from the front, the mounting nut 32 is then threaded onto threads 30 of the shell to tighten the flange 22 against the front of the panel while the mounting nut bears against the rear of the panel thus securing the lock in place in the panel. In order to place the cam 16 and retainer 60 in place, the retainer already being installed on the cam, the cam/retainer combination is inserted through the cylindrical slot 34 and the shell 10 in such a manner that the open arms 62 and parallel sides 64 of the cam engage the flats 42 of the tenon. By pushing the cam inwardly, e.g., by a small screwdriver and significant force, the open arms of the retainer 74 spread apart sufficiently to grip the recess 44 of the tenon 38 by gripping portions 76 which thus hold the cam rigidly onto the tenon. Because the retainer 60 will fit on either side of the cam 16, the cam can be reversed; thus adding flexibility to installation possibilities.

In operation, the proper key 14 is inserted into the plug 12 in a known manner The key is turned which causes turning of the tenon 38 to simultaneously operate the cam 16, e.g., to lock a door, and the switch assembly 18, e.g., to control the circuit. One example of use is a computer aided drafting machine wherein a cam lock holds a door shut and a switch turns the power on. Thus, if the key is operated to open the door, the power will be shut off providing a safety factor and allowing one lock to replace normally two locks, i.e., a separate lock for switching the power and a separate lock for controlling the opening of a door (or panel or other moveable member).

As can be seen, this invention provides a unique combination switch lock/cam lock assembly which is highly defeat resistant by means of a one-piece shell insertable from the panel front and locked from the rear. To allow a shell to be inserted from the panel front the cam must not be on the shell when inserted thus, the invention has provided a unique arrangement of an attachable cam and cam retainer for assembling the cam onto the lock's plug tenon.

What is claimed is:

1. A combination switch lock/cam assembly adapted for mounting through an opening in a panel or the like from the outside of the panel, the assembly comprising:

(a) a one piece cylindrical shell having a flanged head at an outer end, central axial opening for a lock plug and a circumferential opening in a side of the shell to accommodate a cam, (b) means for mounting the shell in the panel opening, (c) a cylindrical lock plug carried within the axial opening in the shell, the lock plug having a keyway entering from its front face, lock tumblers, and an axially extending tenon extending from the rear of the plug, (d) an electric switch assembly mounted on an inner end of the shell and operated by turning the plug with a proper key, (e) a cam having one end shaped to fit over the side of the plug tenon, the cam extending through the circumferential opening in the side of the shell, (f) means for detachably connecting and retaining the cam on the plug tenon so that the cam can be connected after the plug and shell is inserted through the opening in the panel, (g) the means for detachably connecting and retaining the end of the cam to the plug tenon comprising a retainer attachable to the cam and insertable through the opening in the side of the shell, the retainer engaging the plug tenon to prevent the retainer and cam from moving relative to the plug tenon, and wherein the retainer has spreadable arms on one end for snapping over and gripping the plug tenon and has the other end formed to engage an opening in the cam so that the retainer is attached to a hole in the cam and snaps over a groove in the plug tenon to hold the cam rigidly to the plug tenon.

2. A cam and retainer assembly for use with a cam lock having a plug tenon to which the cam is attached, the cam and retainer assembly comprising:

(a) a cam having an opening therein and having one end with spaced arms to engage and be rotated by the plug tenon, (b) a retainer member having an end portion insertable into the opening in the cam and affixing the retainer to the cam, the retainer having open gripping arms, the arms being resilient enough to be slipped over the plug tenon and to engage the plug tenon on the side of the center line opposite the extension of the cam so that the cam is rigidly retained to the plug tenon.

3. In a switch lock/cam lock combination of the type including a cylindrical shell mounting a cylinder lock plug having a tenon which rotates a cam extending through a slit in the side of the shell and simultaneously operates an electrical switch, improvements allowing such lock to be mounted from the front of the panel and for improving the defeat resistance of the lock, the improvements comprising:

(a) a flanged head integral with the shell for contacting the front of the panel around the panel opening, (b) a removable cam insertable with one end configured to cooperate with the tenon and to be operated thereby and having a gripable opening therein, the cam being insertable through the slit in the side of the shell after the lock is inserted through the side of the shell after the lock is inserted through the panel from the front, (c) a cam retainer spring attachable to the cam and the tenon to hold the cam to the tenon, the cam retainer having a pair of spaced-apart spring arms for gripping a groove in the plug tenon and having a portion formed to fit into the opening in the cam.

* * * * *

UNITED STATES PATENT AND TRADEMARK OFFICE

CERTIFICATE OF CORRECTION

PATENT NO. : 4,829,798

DATED : May 16, 1989

INVENTOR(S) : Stevie C. Roop

It is certified that error appears in the above-identified patent and that said Letters Patent is hereby corrected as shown below:

Column 1, line 12, delete "switches Me" and substitute therefor -- switches. Me --;

Column 3, line 41, delete "66" and insert --76--

Column 3, line 42, delete "tee" and substitute therefor -- the --.

Signed and Sealed this

Sixteenth Day of October, 1990

*Attest:*

*Attesting Officer*

HARRY F. MANBECK, JR.

*Commissioner of Patents and Trademarks*